US005088122A

United States Patent [19]

O'Toole

[11] Patent Number: 5,088,122

[45] Date of Patent: Feb. 18, 1992

[54] GOLF SWING TRAINING GLOVE

[76] Inventor: Martin R. O'Toole, 18 Clare Ter., Pembroke, Mass. 02359

[21] Appl. No.: 662,074

[22] Filed: Feb. 28, 1991

[51] Int. Cl.[5] ..... A41D 19/00

[52] U.S. Cl. ..... 2/161 A

[58] Field of Search ..... 2/161 A, 162, 160, 159, 2/; 273/189 R, 166

[56] References Cited

U.S. PATENT DOCUMENTS

| | | | |
|---|---|---|---|
| 2,481,333 | 9/1958 | Roessler | 2/161 A |
| 3,105,972 | 10/1963 | Christopher | 2/161 A |
| 3,274,616 | 9/1966 | Russo | 2/161 A |
| 3,348,238 | 10/1967 | Hydock | 2/161 A |
| 3,408,657 | 11/1968 | Gallagher | 2/161 A |
| 3,918,097 | 11/1975 | Mlodoch | 2/161 A |
| 4,042,977 | 8/1977 | Antonious | 2/161 A |
| 4,051,552 | 10/1977 | Widdemer | 2/161 A |
| 4,057,255 | 11/1977 | Bishop | 2/161 A X |
| 4,587,673 | 5/1986 | Boliard | 2/161 A |
| 4,643,428 | 2/1987 | Churchill | 273/166 |
| 4,665,565 | 5/1987 | Odom | 2/161 A |
| 4,730,354 | 5/1988 | Saito | 2/161 A |

*Primary Examiner*—Werner H. Schroeder
*Assistant Examiner*—Sara M. Current
*Attorney, Agent, or Firm*—Henderson & Sturm

[57] ABSTRACT

A golf grip training glove apparatus (10) for teaching the proper grip on the handle (201) of a golf club (200); wherein, the apparatus (10) includes a conventional golf glove construction (100) equipped with an elongated strap member (20) adapted to captively encircle the users gripping hand around the handle (201) of a golf club (200).

3 Claims, 2 Drawing Sheets

FIG. 5.
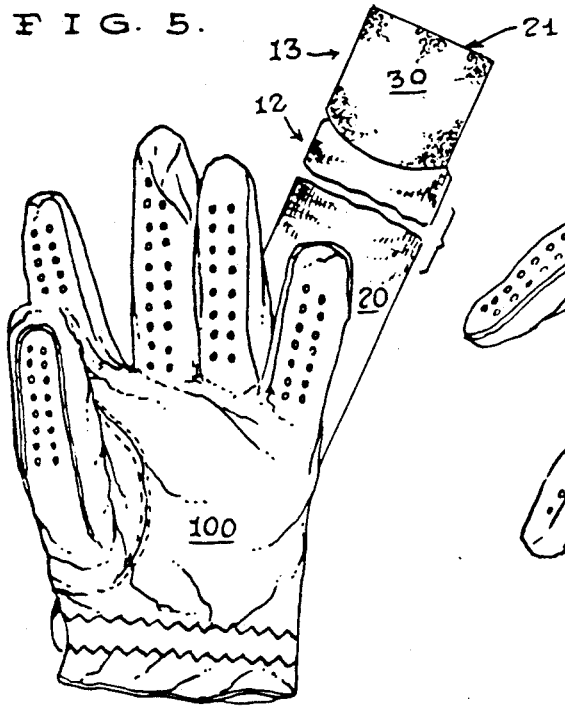
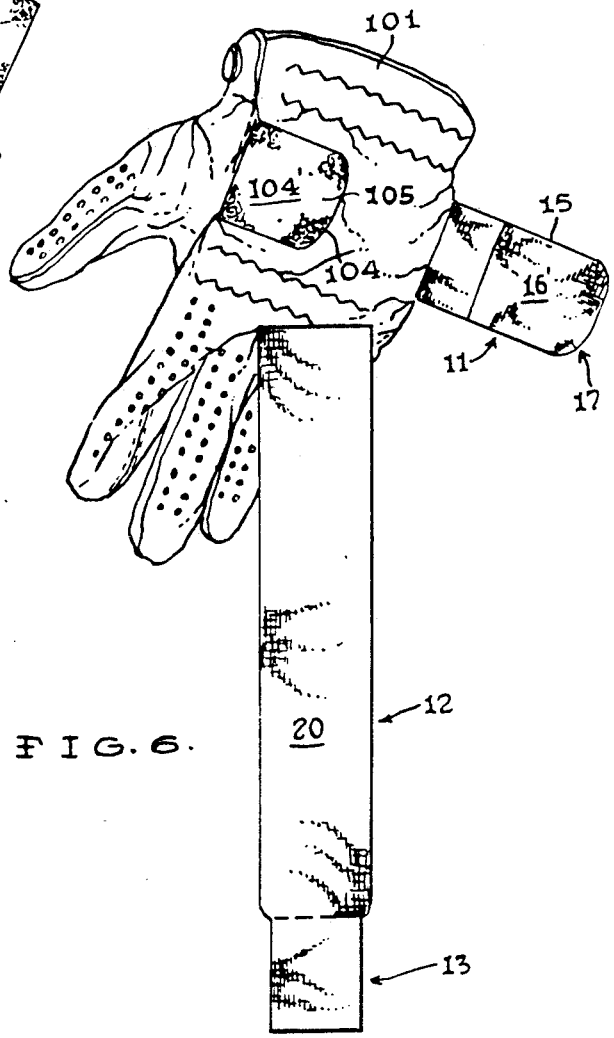
FIG. 6.
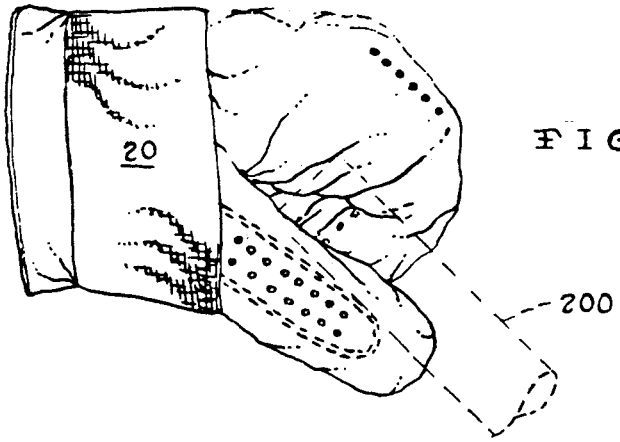
FIG. 7.

GOLF SWING TRAINING GLOVE

BACKGROUND ART

This invention was the subject matter of Document Disclosure Program Registration No. 257,555 which was filed in the U.S. Patent and Trademark Office on July 16, 1990.

As can be seen by reference to the following U.S. Pat. Nos. 4,643,428; 4,587,673; 4,730,354; and 4,665,565; the prior art is replete with myriad and diverse golf grip training glove arrangements.

While all of the aforementioned prior art constructions are more than adequate for the basic purpose and function for which they have been specifically designed, these arrangements do not offer the same degree of effectiveness nor secure fastening that is provided by the subject matter of the present invention.

Furthermore only one of the cited prior art patents employs a single glove arrangement; and, this particular patent is directed to providing support for the users wrist and is not concerned at all with trying to force a golfer to grip a golf club in the proper manner.

As a consequence of the foregoing situation, there has existed a longstanding need among golfers for a golf glove training apparatus that would prevent the golfer from opening their hand at the top of the swing thereby eliminating slices and hitting on top of the ball; and, the provision of such a construction is a stated objective of the present invention.

DISCLOSURE OF THE INVENTION

Briefly stated, the golf grip training apparatus that forms the basis of the present invention comprises a conventional golf glove construction that is modified by the following features; a double surfaced releasable closure unit disposed on the top surface of the conventional golf glove closure member; and, an elongated strap unit fixedly secured on one end to the back of the golf glove; wherein, the other end of the strap unit is provided with a complimentary closure unit that will operatively engage the releasable closure unit.

As will be explained in greater detail further on in the specification, when the complimentary closure unit engages the releasable closure unit; the elongated strap unit will captively engage only three of the users fingers with the exception of the index finger and the base of the thumb of the users gloved hand around a golf club handle grip, such that the golfer is constrained from relaxing their grip on the club.

Consequently usage of this invention will not only teach the golfer the correct manner of gripping the golf club; but will also create muscle memory through repetitive usage such that the golfers hand will automatically assume and maintain the proper grip even when the golfer is using a glove that is not equipped with the structural innovations embodied in this invention.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 5 is a bottom plan view of the golf glove;

FIG. 6 is a top plan view of the golf glove in another partially closed position; and;

FIG. 7 is a side perspective view of the golf glove apparatus in the operative mode of disposition.

BEST MODE FOR CARRYING OUT THE INVENTION

Figure 1:
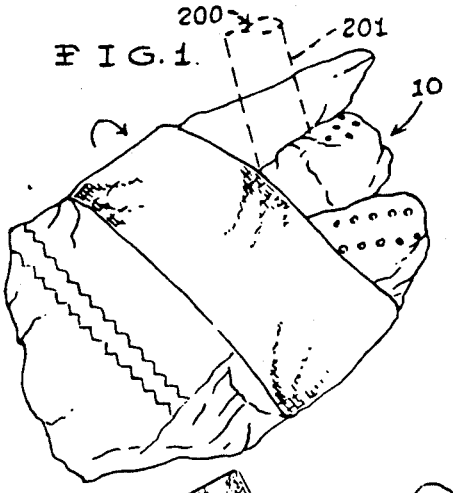
FIG. 1 is a front perspective view of the golf glove apparatus being used to grip a golf club.
Figure 2:
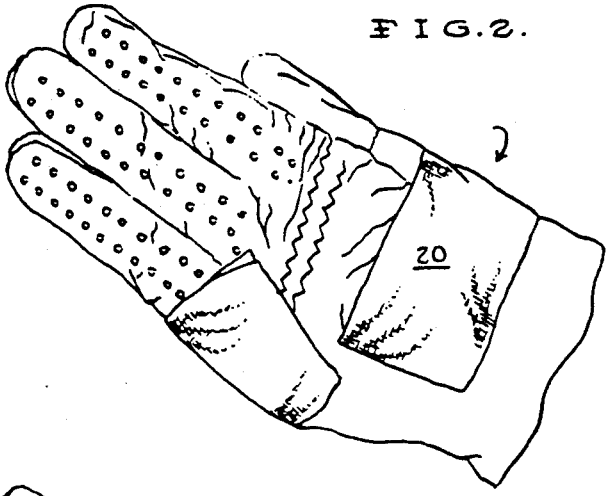
FIG. 2 is a rear view of the golf glove in the operative mode of disposition.
Figure 3:
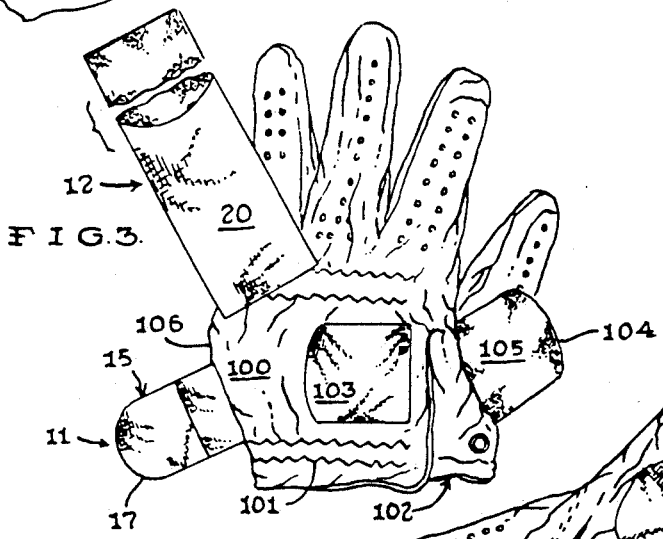
FIG. 3 is a top plan view of the golf glove in the open position.

As can be seen by reference to the drawings, and in particular to FIG. 1 the golf grip training glove apparatus that forms the basis of the present invention is designated generally by the reference numeral (10). As shown in FIG. 3, the apparatus (10) comprises a conventional golf glove construction (100) provided with a double sided releasable closure unit (11) and an elongated strap unit (12) having a complimentary closure unit disposed on its free end. These units will not be described in seriatim fashion.

As can best be appreciated by reference to FIG. 3, the conventional golf glove construction (100) comprises a golf glove that typically covers the left hand of a right handed golfer; wherein, the golfers left hand is the golf club gripping hand and the right hand is the golf club guiding hand.

Furthermore the golf club construction (100) has a top surface (101) provided with an opening (102) which is controlled by a pair of cooperating closure flaps (103) and (104) which are engaged in an overlapping fashion to provide a snug fit around the users wrist.

Turning now to FIG. 6 it can be seen that the top (104') the overlapping closure flap (104) is provided with a hooked surface (105) whose purpose and function will be described presently.

Figure 4:
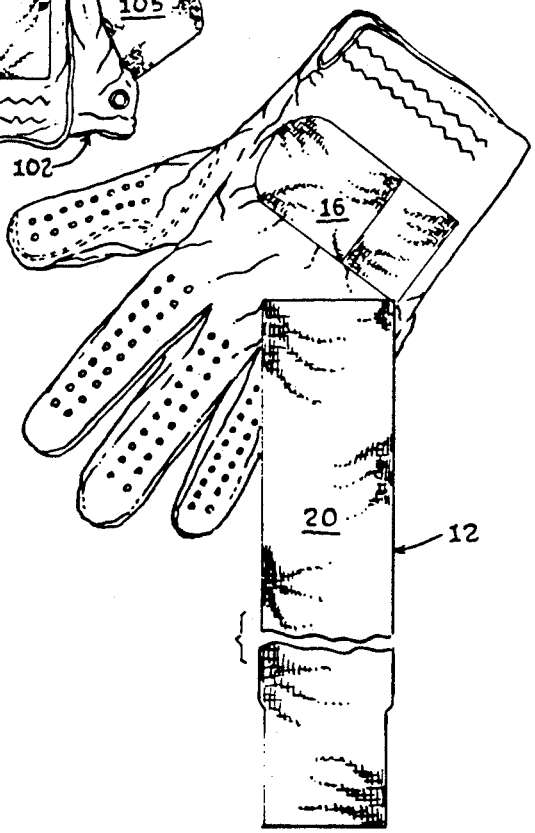
FIG. 4 is a top plan view of the golf glove in the partially closed position.

As shown in FIGS. 3, 4 and 6, the double sided releasable closure unit (11) comprises a releasable flap closure member (15) operatively attached on the pinky side (106) of the golf glove construction; wherein, the releasable flap closure member (15) has a double sided looped surface (16) (16') formed on the top and bottom of the free end (17) of the flap closure member (15).

In addition, the releasable flap closure member (15) is of sufficient length such that the bottom looped surface (16') will releasably engage the hooked surface (105) on the top (104') of overlapping closure flap (104).

As can best be seen by reference to FIGS. 4 and 5, the elongated strap unit (12) comprises an elongated generally flat and wide strap member (20) secured on the top (101) of the glove construction (100) proximate the middle and index fingers of the glove construction. Furthermore, the free end (21) of the strap member (20) is provided with the complimentary closure unit (13).

The complimentary closure unit (13) comprises another hooked surface (30) wherein, the strap member (20) is dimensioned to encircle the users pinky, ring, and middle fingers and the base of the thumb as well as the handle grip (201) of the golf club (200) to bring the hooked surface (30) into engagement with the top looped surface (16) of the flap closure member (15); whereby the users gloved hand will be immobilized in the correct position relative to the golf club (200) as depicted in FIGS. 1 and 7.

In an alternate version of the preferred embodiment (not shown) the top surface (104') of the overlapping closure flap (104) is provided with a looped surface (104''); whereby the releasable flap closure member (15) may be dispensed with; in as much as, the hooked surface (30) on the end of strap member (20) will engage this looped surface (104'') in almost the same manner as the engagement in the preferred embodiment of the invention between the looped surface (30) and the top looped surface (16) of the flap closure member (15).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A golf grip training glove apparatus for teaching the proper grip on the handle of a golf club wherein the apparatus comprises:

a golf glove construction; wherein the golf glove construction has a top, two sides, a bottom; and an opening controlled by a pair of cooperating closure flaps; wherein, a top surface of one of the pair of cooperating closure flaps is provided with a first hook and loop fastener a releasable flap closure member secured on one end to the top of the golf glove construction and having a free end provided with second and third hook and loop fasteners on both the top and bottom of said free end; wherein, the second hook and loop fastener on the bottom of the free end of the releasable flap closure member releasably engages the first hook and loop fastener dispensed on the top of the said one of the pair of cooperating closure flaps; and, an elongated strap unit comprising an elongated flat wide strap member secured on one end to the top of the golf glove construction; wherein the other end of the strap member is provided with a fourth hook and loop fastener; wherein, the strap member is of sufficient length to encircle the users fingers and the base of the thumb as well as the handle of said golf club when said fourth hook and loop fastener is engaged with said third hook and loop fastener on the top surface of the releasable flap closure member.

2. The training glove apparatus as in claim 1; wherein, said first and fourth hook and loop fasteners comprise hooked elements; and, said second and third hook and loop fasteners comprise looped elements.

3. The training glove apparatus as in claim 1; wherein, said first and fourth hook and loop fasteners comprise looped elements; and, said second and third hook and loop fasteners comprise hooked elements.

* * * * *